US006510572B2

(12) United States Patent
Horowitz

(10) Patent No.: US 6,510,572 B2
(45) Date of Patent: Jan. 28, 2003

(54) BED CURTAIN DIVIDER

(76) Inventor: David A. Horowitz, 6 Hyer Dr., Simsbury, CT (US) 06070

( * ) Notice: Subject to any disclaimer, the term of this patent is extended or adjusted under 35 U.S.C. 154(b) by 97 days.

(21) Appl. No.: 09/827,497

(22) Filed: Apr. 6, 2001

(65) Prior Publication Data

US 2002/0144347 A1 Oct. 10, 2002

Related U.S. Application Data

(60) Provisional application No. 60/214,922, filed on Jun. 29, 2000.

(51) Int. Cl.[7] ..... A47G 5/00; A47G 31/00

(52) U.S. Cl. ..... 5/513; 5/512; 5/658; 160/351; 160/368.1; D6/383

(58) Field of Search ..... 5/513, 512, 658; 160/351, 368.1; D6/383, 382

(56) References Cited

U.S. PATENT DOCUMENTS

| | | | | | |
|---|---|---|---|---|---|
| 418,946 | A | * | 1/1890 | Griffith | 5/512 X |
| 930,554 | A | | 8/1909 | Moody | 5/513 |
| 1,432,383 | A | | 10/1922 | Comings | 5/513 |
| 1,472,731 | A | | 10/1923 | Marvin | 5/513 |
| 1,875,522 | A | * | 9/1932 | Sweet | 5/513 |
| 1,979,520 | A | | 11/1934 | Abrams et al. | 5/513 |
| 2,510,656 | A | * | 6/1950 | Randel | 5/513 |
| 2,556,913 | A | * | 6/1951 | Gilbert | 5/513 |
| 4,890,346 | A | * | 1/1990 | Rist | 5/513 X |
| D360,775 | S | * | 8/1995 | Karkoska et al. | D6/383 |
| 5,457,830 | A | | 10/1995 | Fox et al. | 5/486 |
| 5,560,058 | A | * | 10/1996 | Smith | 5/513 |
| 5,681,259 | A | * | 10/1997 | August | 160/10 X |
| 5,718,254 | A | * | 2/1998 | Murphy | 5/113 X |
| 6,321,823 | B1 | * | 11/2001 | Whittemore | 160/368.1 |

FOREIGN PATENT DOCUMENTS

| | | | | |
|---|---|---|---|---|
| DE | 3440200 | * | 5/1986 | 5/512 |
| GB | 2113987 | * | 8/1983 | 5/93.1 |

* cited by examiner

*Primary Examiner*—Jong-Suk (James) Lee
(74) *Attorney, Agent, or Firm*—Cantor Colburn LLP

(57) ABSTRACT

A bed curtain divider for individuals sharing a bed, the bed curtain includes a substantially flexible barrier for shielding light rays from an individual on lying on the bed, the barrier comprising a first section having a first releasable attachment for attaching to a wall proximate a head portion of the bed, a second section operably adapted to maintain a first edge of the barrier intermediate the first corner and the second corner in tension, and a third section proximate the head portion of the bed.

28 Claims, 3 Drawing Sheets

BED CURTAIN DIVIDER

CROSS-REFERENCE TO RELATED APPLICATIONS

This application claims the benefit of U.S. Provisional Application Ser. No. 60/214,922 filed Jun. 29, 2000.

BACKGROUND

Many couples are mismatched in their sleep habits. For example a "night owl" may stay up late reading or watching television, or may wake during the night, while an "early bird" generally will sleep early and wake early. When an individual is an early bird and shares a bed with a night owl, that couple has a problem with no readily available solution.

The night owl can leave the room, but may prefer to read in bed, finding it helps the night owl to fall back to sleep. The night owl resents being forced from bed by a sensitive early bird. The early bird can wear eyeshades, but may find this uncomfortable too, unless the early bird is prepared to wear the eyeshades every night, the early bird must anticipate the night owl's behavior. The night owl can construct rudimentary barriers with pillows and the like, but such barriers are awkward and can collapse with unfortunate results. The couple can sleep in separate bedrooms, but this may damage their relationship.

BRIEF SUMMARY

A bed curtain for individuals sharing a bed, the bed curtain including a substantially flexible barrier for shielding light rays from an individual lying on the bed, said barrier comprising a first section having a first releasable attachment for attaching to a wall proximate a head portion of the bed, a second section operably adapted to maintain a first edge of the barrier in tension intermediate the first corner and the second corner, and a third section proximate the head portion of the bed.

DETAILED DESCRIPTION

Figure 1:
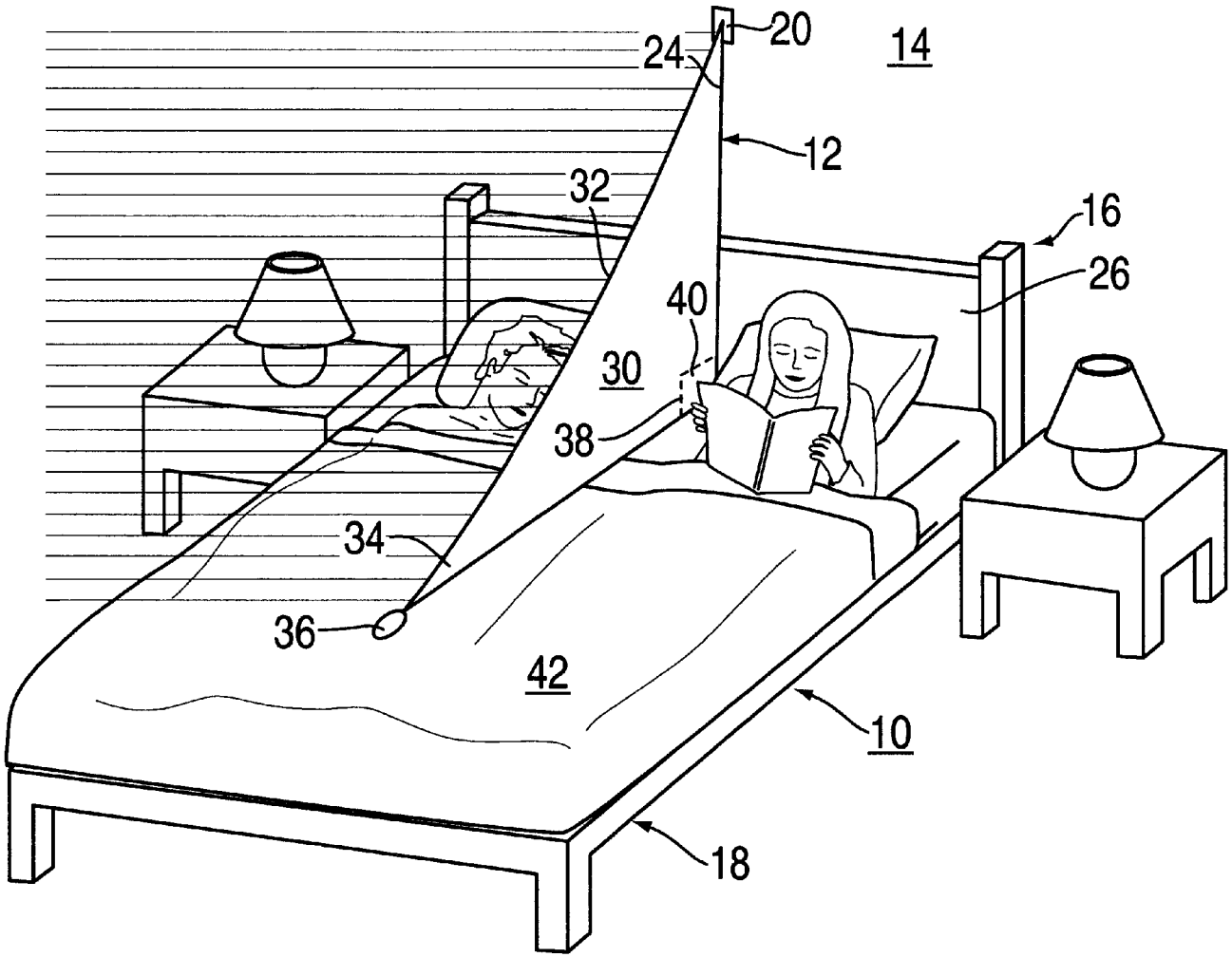
FIG. 1 is a perspective view of two individuals sharing a bed having an exemplary embodiment of a bed curtain divider between the individuals.

Referring to FIG. 1, two individuals 8, 9 sharing a bed, the bed generally shown at 10, are separated by a bed curtain divider 12. Bed curtain divider 12 is releasably attached to a wall 14 proximate a head portion 16 of bed 10, preferably above the heads of the individuals with the individuals lying down on the bed 10. Bed curtain divider 12 includes a first releasable attachment 20, such as, but not limited to, a hook and loop fastener (e.g., Velcro® or the like), a magnetic coupling, or a reinforced opening and/or length of string for attachment to a mounting fixture on wall 14, disposed at a first section 24 of said divider 12 for attachment to wall 14. In an exemplary embodiment, a hook and loop fastener is approximately 2–4 square inches, dependent on the weight of the bed curtain divider. One portion of the first releasable attachment 20 is fixed to first section 24 and another portion is fixed to wall 14. It is preferable that first releasable attachment 20 is colored with a color that matches the color of wall 14 covering. It should be noted that the other portion of fastener 20 is optionally attached to a headboard 26 when headboard 26 extends fat enough towards the ceiling and above the head of an individual lying down on the bed 10.

In an exemplary embodiment, bed curtain divider 12 is a right triangle, lightweight, and substantially flexible for easy folding and storage. Bed curtain divider 12 comprises a substantially opaque barrier 30 for shielding light rays from an individual sharing the bed, so the individual will remain sleeping unaffected from such light rays. The light rays are emitted from, but not limited to, a lamp or a television. Exemplary embodiments of barrier 30 include utilization of a flexible material that is noise-free upon incidental contact while sleeping or when mounting the divider 12 while one individual is sleeping. Other embodiments include utilization of a material impervious to airborne media such as undesirable breath odor and infectious disease transferred and carried by ones breath. In the event that one individual desires to sleep with a window open, other exemplary embodiments of the divider 12 include a wind resistant material to shield the other individual from a draft from the open window. Still further, it should be noted that bed curtain divider 12 optionally includes a sound insulative material for insulating sound from a sleeping individual. For example, a quilted material is utilized for reducing the sound of turning pages in a book potentially heard by a sleeping individual.

A first edge 32 depends from first section 24 at one end and from a second section 34 at another end towards a foot portion 18 of the bed 10. Second section 34 is operably adapted to maintain first edge 32 in tension by disposing a second weighted object 36 (e.g., bean bag, bean bag animated figure, or the like) at second section 34. Second weighted object 36 is heavy enough to maintain first edge 32 in tension and prevent second section 34 from moving. In alternative embodiments of divider 12, first edge 32 is optionally kept taut having a length of cable or rigid member with one end releasably attachable to wall 14 and another end releasably attachable to foot portion 18, wherein first edge 32 depends therefrom, thus preventing a sagging barrier 30.

A third section 38 of divider 12 substantially comprises a right angle of the right triangularly shaped barrier 30. Third section 38 is proximate the head portion 16 of the bed 10. In an exemplary embodiment, third section 38 includes a third weighted object 40 disposed at third section 38 to operably bias the third section 38 towards the bed 10 and the wall 14 to aid in shielding light rays from an individual on either side of barrier 30. Third weighted object 40 is preferably incorporated in third section 38 to eliminate potential discomfort associated with disposing a separate weighted object (e.g., a bean bag).

Figure 2:
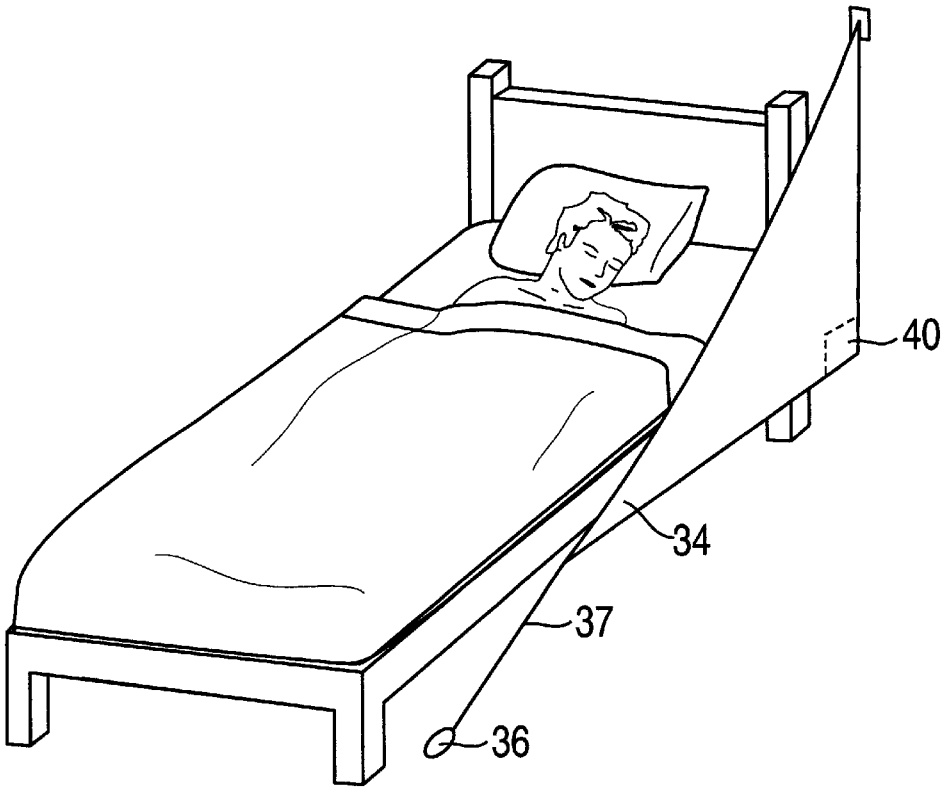
FIG. 2 is a perspective view of another exemplary embodiment of a bed curtain divider having one attachment to a foot portion of the bed.

Second section 34 optionally includes second weighted object 36 permanently disposed at second corner 34. For example, second weighted object 36 is optionally attached to second section 36 by sewing, gluing, hook and loop fastened or the like. Turning to FIG. 2, a length of string 37 intermediate second section 34 and second weighted object 36 is optionally included to utilize the bed curtain divider 12 between two separate beds or on a side 41 of the bed to shield an individual from a light source on side 41.

Referring to FIGS. 1 and 2, it will be appreciated that in some situations, tension in first edge 32 may not be maintained because a bed cover sheet 42 may move caused by an individual kicking the sheet 42, and therefore causing second weighted object 36 to possibly move towards the head portion 16. To alleviate this situation, the length of string 37 with second weighted object 36 is draped over the foot portion 18 or footboard (not shown) to keep first edge in tension. Alternatively, second weighted object 36 is draped over the foot portion 18 and further tucked under the bed mattress 43.

Figure 3:
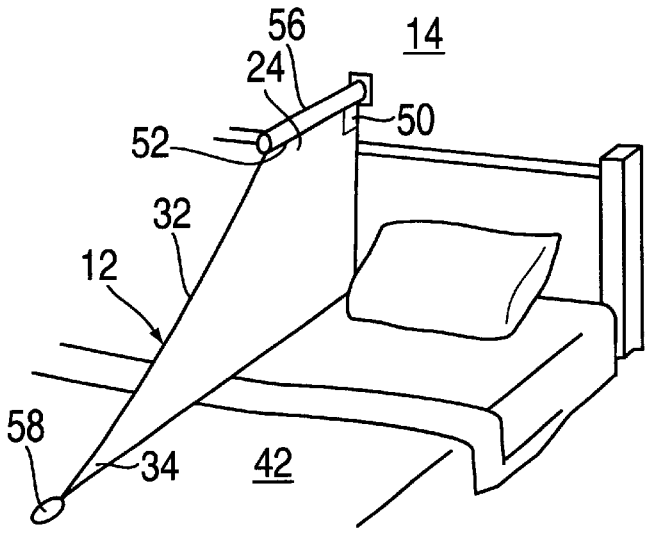
FIG. 3 is a perspective view of an alternative embodiment of the bed curtain divider of FIG. 1.

In alternative embodiments, second section 34 includes a second releasable attachment 58 for locating second section 34 proximate the foot portion 18 of bed 10 in place of utilizing second weighted object 36 (See FIG. 3). Second releasable attachment 58 includes, but is not limited to a Velcro® (hook and loop fastener), magnetic coupling, snap fastener, safety pin, length of string, or the like. For example, a length of string is optionally included for tying to a footboard, bed rail or bed slat.

Referring to FIG. 3, an alternative embodiment of divider 12 is shown having first section 24 configured having a substantially right angle 50 having a second edge 52 as one side of right angle 50 depending from first edge 32. Second edge 52 depends from a structural support 56 that depends from wall 14. Second section 34 further comprises second releasable attachment 58 releasably coupled to bed cover sheet 42. It will be appreciated that structural support 56 is optionally configured to hingedly pivot to reside against wall 14 when divider 12 is not attached and optionally includes a telescopic feature for increased versatility. For example, when structural support is extended telescopically, first edge 32 is configured to depend therefrom. Structural support 56 is optionally configured to support a light fixture for reading.

Figure 4:
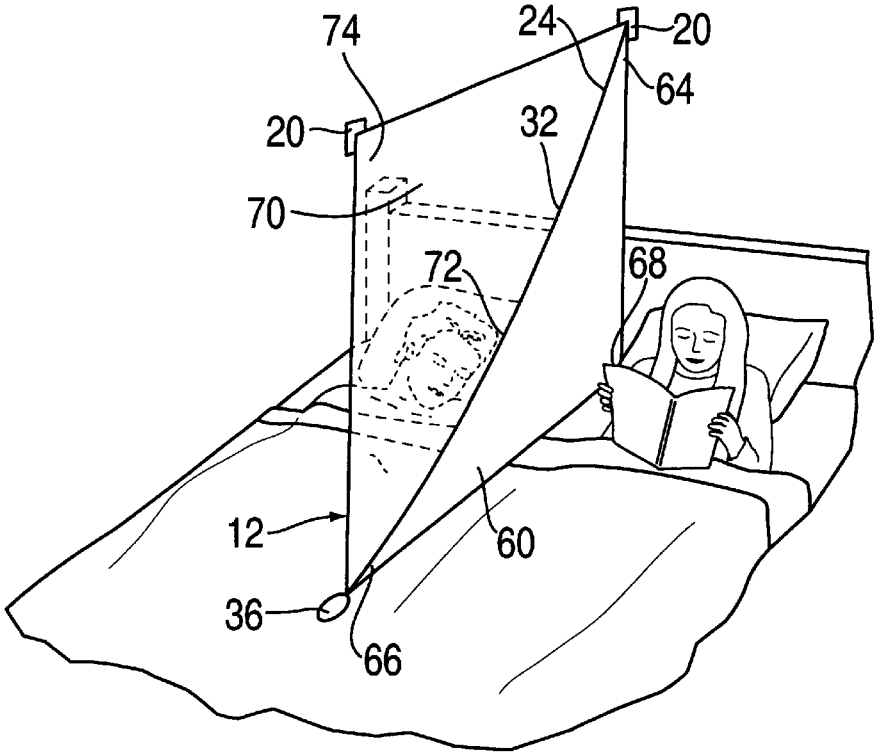
FIG. 4 is a perspective view of another alternative embodiment of the bed curtain divider of FIG. 1.

Referring to FIG. 4, an alternative embodiment is shown for shielding additional light. Divider 12 comprises a substantially rectangular shape. One half of the rectangular shape is configured having a first right triangle 60 having first section 24 as a first corner 64, second section 34 as a second corner 66, and third section 38 as a third corner 68. The other half of the rectangular shape is configured with a second right triangle 70 having a hypotenuse 72 coincide with a hypotenuse of the first right triangle 60, the hypotenuse 72 being first edge 32. Second right triangle 70 further comprises a fourth corner 74 opposite third corner 68, both third and fourth corner are substantially right angles. Fourth corner 74 has another first releasable attachment 20 for attaching to wall 14.

In operation, the alternative embodiment in FIG. 4 has first right triangle 60 set up as shown in FIG. 1 and described above, however, another first releasable attachment 20 disposed at fourth corner 74 of second right triangle 70 is preferably attached to wall 14 at substantially the same latitude as first releasable attachment 20 at first corner 64 is attached to wall 14. When mounted in the above described manner, second right triangle 70 further shields light from an individual sharing bed 10.

Figure 5:
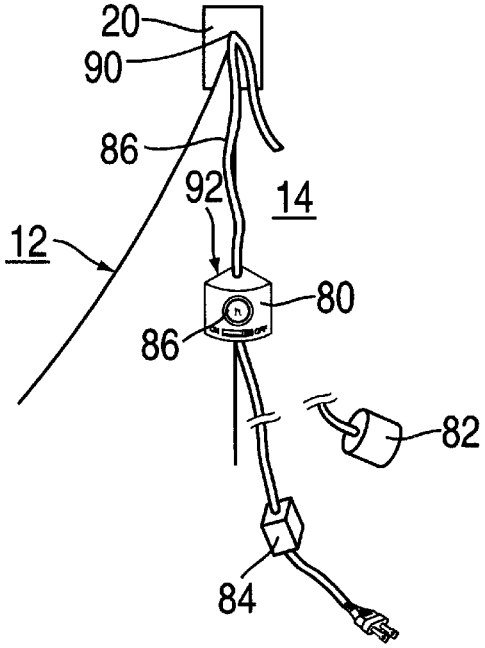
FIG. 5 is a perspective view of the bed curtain divider of FIG. 1 having a light source attached for reading.
Figure 6:
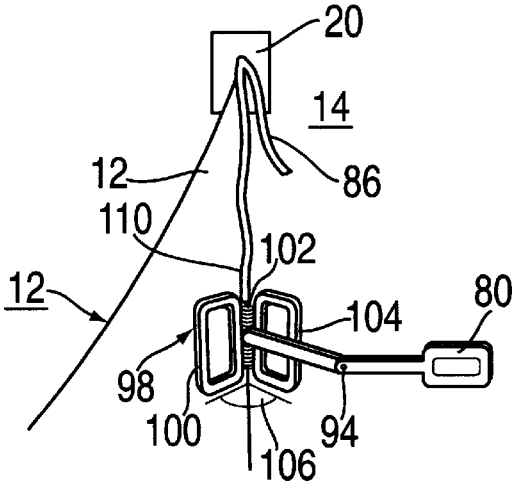
FIG. 6 is a perspective view of the bed curtain divider of FIG. 1 having an alternative embodiment of a light source attached for reading.

Turning to FIGS. 5 and 6, releasable attachment 20 is optionally configured for mounting a light source 80 for reading. Light source 80, for example, comprises a low power six watt book light that is electrically operated via a battery pack 82 or a transformer 84 plugged into an electrical socket. In an exemplary embodiment, releasable attachment 20 comprises a spring-type clamp (not shown) depending from a Velcro fastener depending from wall 14, the clamp releasably clamps a length of cord 86 that is intermediate the electrical power supply and the light source 80. The clamp includes for example, but is not limited to, a butterfly-type binder clamp conventionally utilized as a paper clip or a biased retainer clip having an aperture sized to slidably engage an electrical cord and biased to restrict movement of the electrical cord within the aperture (e.g., cord lock or compression string utilized on a parka drawstring). The light source 80 dangles against the divider 12 and wall 14 by clamping a length of cord 86 such that the light fixture is approximately twelve inches below a top portion 90 of divider 12. By disposing the clamp at releasable attachment 20, a precise height of the light source 80 may be obtained and also permits the light 80 to be shifted to the other side of the divider 12. In the event first releasable attachment comprises a mounting fixture (not shown) depending from wall 14, a length of cord 86 is optionally suspended on the mounting fixture to suspend the light source 80 at a desired height.

Referring to FIG. 5, light source 80 optionally includes a fixed recessed bulb 86 capable of projecting light comfortably one to three feet to a book. A rear portion 92 of light source 80 is preferably configured to retain a suspended light source 80 against wall 14 and divider 12, such that light projection is at approximately a 45 degree angle from wall 14 directing light to a book. Alternatively, recessed bulb 86 optionally includes adjustment of the angle of emitted light, similar to controls on an airplane or bus passenger seat light disposed above the head of an occupant.

Referring to FIG. 6, an alternative embodiment of light source 80 optionally includes an articulated neck 94, as in conventional book lights that depend from a book, allowing some flexibility for positioning light source 80. Articulated neck 94 depends from a foldable base 98. Foldable base 98 stores and contains articulated neck 94 for compact storage and protection of light source 80. Foldable base comprises a first side 100 hingedly attached on one edge with a hinge 102 to one edge of a second side 104. When foldable base 98 is opened, hinge 102 restricts further opening of base 98 past a point where first side 100 creates a 90-degree angle 106 with second side 104. The 90-degree angle 106 allows light source to remain steady against wall 14 and divider 12 when light source 80 is set up for reading. In an alternative embodiment, hinge 102 is biased to open to 90-degree angle 106 which allows the edges of first side 100 and second side 104 to clamp on a curtain divider edge 110 proximate wall 14 to retain light source 80 in a fixed position. First side 100 then rests against divider 12 and second side 104 rests against wall 14 to restrict movement of light source 80. In FIGS. 5 and 6, since light source 80 is not attached to a book, light source 80 offers significant added convenience, particularly when reading magazines, newspapers, and other awkwardly sized reading material in bed.

It will be understood that a person skilled in the art may make modifications to the preferred embodiment shown herein within the scope and intent of the claims. While the present invention has been described as carried out in a specific embodiment thereof, it is not intended to be limited thereby but intended to cover the invention broadly within the scope and spirit of the claims.

What is claimed is:

1. A bed curtain divider for individuals sharing a bed, said bed curtain divider comprising:

a substantially flexible barrier comprising a light shielding material;

a first section having a first releasable attachment for attaching said first section to a wall proximate a head portion of said bed;

a second section operably maintaining a first edge of said barrier in tension, said first edge intermediate said first section and said second section; and a third section proximate said head portion of said bed.

2. The bed curtain divider in claim 1 wherein said first edge is depending from a structural support, said structural support at one end is releasably attachable to said wall and at another end releasably attachable to a foot portion of said bed.

3. The bed curtain divider in claim 1 wherein said barrier comprises a material to shield airborne media from an individual on said bed.

4. The bed curtain divider in claim 1 wherein said third section is operably biased towards said bed.

5. The bed curtain divider in claim 1 wherein said barrier comprises a lightweight fabric substantially noise-free upon contact.

6. The bed curtain divider in claim 1 wherein said barrier comprises a quilted material for sound insulation.

7. The bed curtain divider in claim 1 wherein said barrier comprises a wind resistant material.

8. The bed curtain divider in claim 1 wherein said barrier comprises a material resistant to odor transfer.

9. The bed curtain divider in claim 1 wherein said barrier comprises a first right triangle having said first section as a first corner, said second section as a second corner and said third section as a third corner.

10. The bed curtain divider in claim 9 wherein said barrier comprises said first right triangle and a second right triangle configured, dimensioned and adapted to form a rectangle having a fourth corner opposite of said third corner.

11. The bed curtain divider in claim 10 wherein said fourth corner includes said first releasable attachment for attaching said fourth corner to said wall for further shielding.

12. The bed curtain divider in claim 10 wherein said first corner includes a reinforced opening for attachment to said wall and said second right triangle is juxtaposed with said first right triangle.

13. The bed curtain divider in claim 1 wherein said first releasable attachment includes one of and combinations employing at least one of the forgoing: a hook and loop fastener, a magnetic coupling, a length of string for attaching to a mounting fixture, and an opening for attaching to said mounting fixture.

14. The bed curtain divider in claim 1 wherein said first section comprises a second edge adjacent said first edge, said second edge depending from a structural support attached to said wall.

15. The bed curtain divider in claim 1 wherein said first section comprises a right angle having a second edge adjacent said first edge, said second edge depending from a structural support attached to said wall.

16. The bed curtain in claim 15 wherein said structural support is configured to support a light source.

17. The bed curtain in claim 15 wherein said structural support is configured to support a cord depending from a light source.

18. The bed curtain divider in claim 1 wherein said second section comprises a second releasable attachment to said bed.

19. The bed curtain divider in claim 18 wherein said second releasable attachment includes one of and combinations employing at least one of the foregoing: a hook and loop fastener, a second weighted object, a second length of string for attaching to a foot portion of said bed, and said second weighted object depending from said second length of string.

20. The bed curtain divider in claim 1 wherein said third section includes a third releasable attachment to a head portion of said bed.

21. The bed curtain divider in claim 20 wherein said third releasable attachment includes and combinations employing at least one of the foregoing: a hook and loop fastener, a magnetic coupling, a third weighted object, a third length of string for attaching to said head portion of said bed, and said third weighted object depending from said third length of string.

22. The bed curtain in claim 1 wherein said first releasable attachment is configured to retain a light source.

23. The bed curtain in claim 1 wherein said first releasable attachment is configured to retain a cord depending from a light source.

24. The bed curtain in claim 1 comprising a light source having a base configured and positioned to project light towards a book and limit movement of said base proximate said wall and said divider.

25. The bed curtain in claim 24 wherein said light source is connected to an articulated neck, said articulated neck is connected to said base.

26. The bed curtain in claim 25 wherein said base comprises a foldable base, said foldable base comprises a first side hingedly coupled with a hinge to a second side, said articulated neck is foldable for compact storage within said foldable base.

27. The bed curtain in claim 26 wherein said hinge operably restricts opening of said first side relative to said second side to approximately a 90 degree angle.

28. The bed curtain in claim 27 wherein said hinge is biased to open and clamp to said divider.

* * * * *